United States Patent [19]

Belloci

[11] 4,143,687

[45] Mar. 13, 1979

[54] PROCESS AND DEVICE FOR CONTROLLING A VESSEL FOR POURING LIQUID UNDER LOW PRESSURE IN A REPEATED MANNER

[75] Inventor: Rio Belloci, Pont-a-Mousson, France

[73] Assignee: Pont-a-Mousson S.A., Nancy, France

[21] Appl. No.: 842,195

[22] Filed: Oct. 14, 1977

[30] Foreign Application Priority Data

Oct. 18, 1976 [FR] France ..... 7631267

[51] Int. Cl.[2] ..... B65B 3/04

[52] U.S. Cl. ..... 141/1; 164/4; 164/155; 264/40.3

[58] Field of Search ..... 164/4, 119, 133, 155; 264/40.3; 141/1

[56] References Cited

U.S. PATENT DOCUMENTS 3,951,199 4/1976 Augustine ..... 164/4

3,961,662 6/1976 Balevski et al. ..... 164/4

*Primary Examiner*—Houston S. Bell, Jr.

*Attorney, Agent, or Firm*—Sughrue, Rothwell, Mion, Zinn and Macpeak

[57] ABSTRACT

A process for controlling a vessel for a repeated pouring of a liquid under low pressure into blind sand moulds. The process comprises after each pouring, lowering the liquid in the pouring tube only to a level which is equal to or substantially equal to a constant predetermined level in the vicinity of the outlet of the tube. According to the invention, the level of the liquid in the tube and the pressure of the driving gas prevailing in the vessel are measured directly and the inlet and exhaust of the driving gas are controlled as a function of these measurements so as to ensure, for all the pourings, a pressure rise time and a pressure drop time which are predetermined and substantially constant. A device is described for carrying out this process.

11 Claims, 3 Drawing Figures

Figure 1:
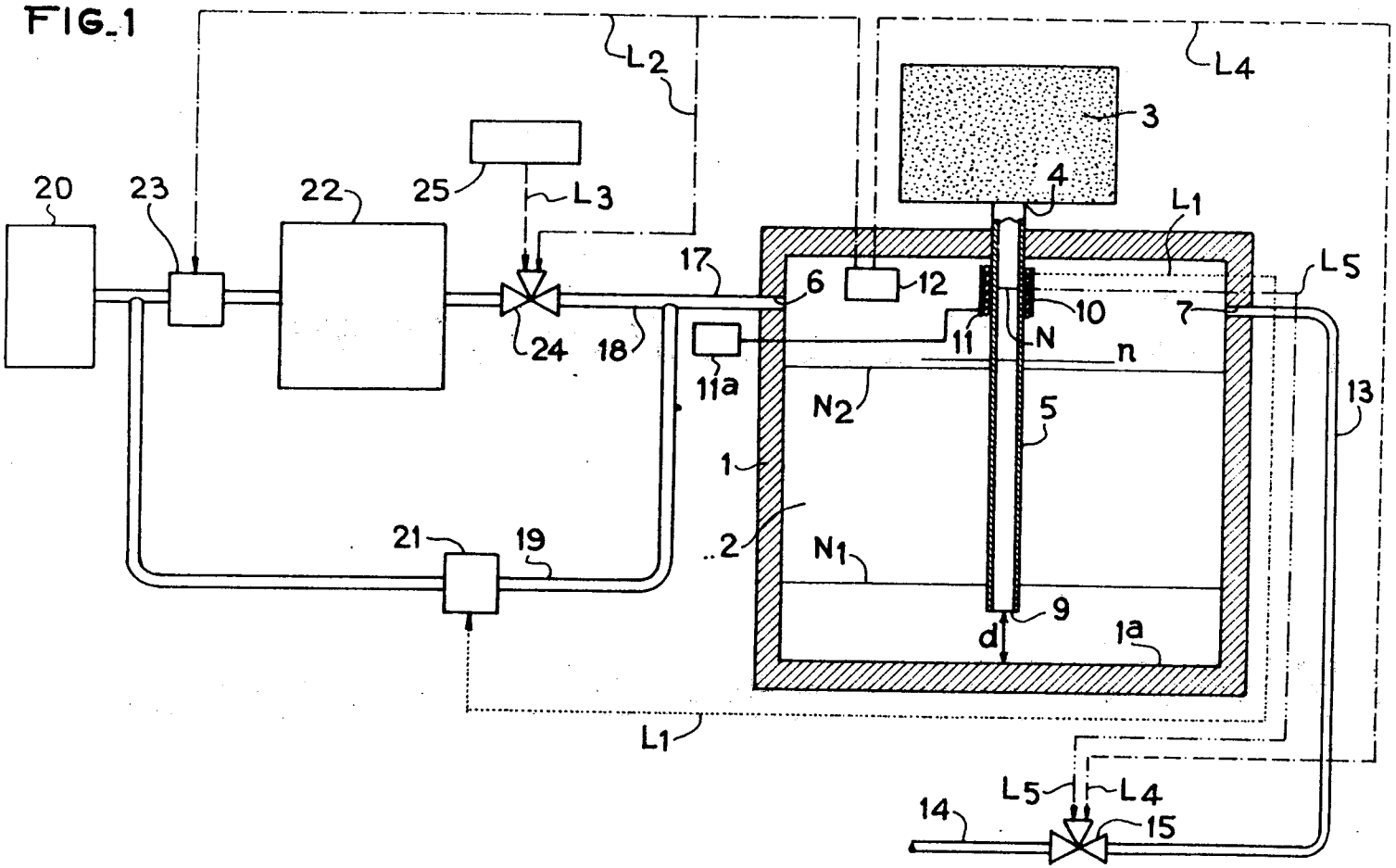

PROCESS AND DEVICE FOR CONTROLLING A VESSEL FOR POURING LIQUID UNDER LOW PRESSURE IN A REPEATED MANNER

The present invention relates to a process and a device for controlling a vessel or ladle for repeatedly pouring under low pressure into blind sand moulds. The invention is more particularly applicable to apparatus for pouring metals having a high melting point (grey cast iron, spheroidal graphite cast iron, steel, etc.) into blind sand moulds such as described in the French Pat. No. 2,295,808. "Repeated pouring" is intended to mean the pouring of successive equal amounts of liquid into a series of moulds.

It is known, for example from French Pat. No. 1,488,313, to control a pouring vessel in such manner as to return the liquid after each pour only to a constant predetermined level in the vicinity of the outlet of the pouring tube. Such a process is very much preferred to a complete release of pressure: repeated thermal shocks on the pouring tube are avoided; the amount of gas required for each pouring is reduced so that the moulding rate can be increased; formation of a solid skin in the pouring tube and the transfer of products of oxidation of this skin into the moulds are avoided; and a permanence of the gas injection and mould filling conditions from one pouring to the other is ensured. To summarize, better products of a well-defined quality are obtained more rapidly.

For this, the French Pat. No. 1,488,313 employs, on one hand, a measurement of the gas pressure prevailing in the vessel and, on the other hand, a weighing of the vessel to enable the extent of the filling thereof to be known.

An object of the present invention is to provide a process and device for controlling the vessel in a simpler and more precise manner which is particularly adapted to the pouring of metal into blind sand moulds.

According to the invention, there is provided a process for controlling a vessel for a repeated pouring of liquid under low pressure into blind sand moulds in which, after each pouring, the liquid is lowered in the pouring tube only to a level which is equal to or substantially equal to a constant predetermined level in the vicinity of the outlet of the tube, wherein the level of the liquid in the tube and the pressure of the driving gas prevailing in the vessel are measured directly and the entry and exhaust of the driving gas are controlled as a function of these measurements so as to ensure, for all the pourings, a pressure rise time and a pressure drop time which are predetermined and substantially constant.

In a first mode of operation, after each pouring, the pressure prevailing in the vessel is returned to the value corresponding to the predetermined level measured before said pouring, then the pressure is increased, in measuring the level of the liquid in the pouring tube until the liquid has risen to said predetermined level.

In a second mode of operation, after each cooling, the driving gas is connected to the exhaust in measuring the level of the liquid in the pouring tube and this connection to the exhaust is stopped when the liquid has descended to said predetermined level.

Also according to the invention, there is provided a device for controlling a vessel for repeatedly pouring liquid under low pressure into blind sand moulds and adapted to contain the liquid to be poured and provided with an upwardly extending pouring tube and inlet and outlet circuits for a driving gas, the device comprising means for measuring the level of the liquid in the tube, a sensor of the pressure of the gas prevailing in the vessel, and means for controlling the inlet circuit and the outlet circuit as a function of the level and of the pressure which are measured in such manner as to ensure, for all the pourings, a pressure rise time and a pressure drop time which are predetermined and substantially constant.

Preferably, for the pouring of magnetically conductive liquids, and in particular metals having a high melting point, the means for measuring the level comprise an inductor connected to an alternating current generator disposed around the upper part of the pouring tube inside the vessel and employing the column of liquid contained in the pouring tube as a plunger core.

Figure 2:
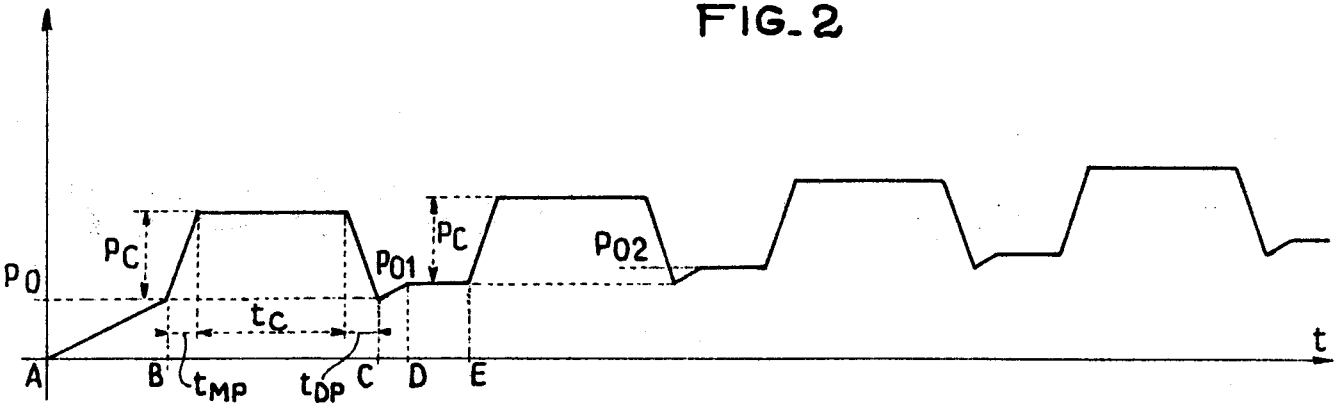
Figure 3:
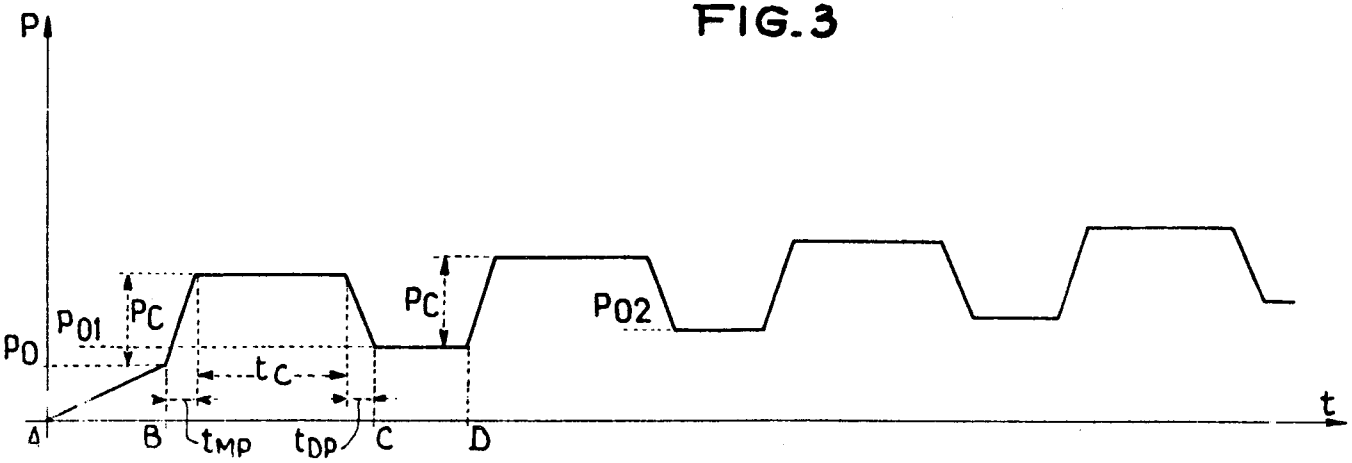

Further features and advantages of the invention will be apparent from the ensuing description, given solely by way of example, with reference to the accompanying drawings in which:

FIG. 1 is a diagrammatic view of a pouring apparatus provided with a control device according to the invention and illustrates two modes of operation of the invention, and FIGS. 2 and 3 represent curves of variation of the pressure prevailing in the vessel above the level of the liquid metal as a function of time respectively for the two modes of FIG. 1.

In the embodiment shown in FIG. 1, the invention is applied to an apparatus for pouring cast iron under low pressure into a series of identical blind sand moulds. This apparatus and the pouring process proper are, for example, those described in said French Pat. No. 2,295,808.

The apparatus comprises a ladle or vessel 1 for containing the liquid metal 2 for filling the moulds 3 which are presented in succession at the upper free end 4 of a vertical pouring tube 5 which extends into the metal in the vessel. The metal 2 is thus delivered from the vessel 1 to the cavities of the moulds 3 by way of the tube 5 under the action of the pressure of a gas supplied to the upper part of the vessel 1 by way of an inlet orifice 6 and escaping from the vessel by way of an outlet orifice 7 which is located substantially on the same level as the orifice 6. The orifices 6 and 7 must in any case be located above the level of the liquid metal in the vessel and are consequently located in the vicinity of the upper wall 8 of the vessel 1. The gas employed for causing the liquid metal to move out of the vessel is preferably completely inert with respect to the liquid metal. It is, for example, nitrogen in the case where the metal is spheroidal graphite cast iron.

The base 9 of the pouring tube 5 is disposed in the vicinity of the bottom $1^a$ of the vessel 1 so as to permit an emptying of the latter in a practically complete manner, a space d being allowed between the base of the pouring tube and the bottom $1^a$ of the vessel 1.

The horizontal lines N1 and N2 show respectively the minimum and maximum levels of the metal in the vessel 1. The horizontal line N in the vicinity of the upper end of the pouring tube 5 represents the constant level which must be maintained in this tube between the pourings, irrespective of the level of the metal in the vessel which varies between the levels N1 and N2.

A copper tube 10 embedded in refractory concrete and coiled into a spiral around the tube 5 in the vicinity of the level N and on each side of the latter, constitutes a level detector or inductor 11 which employs as a plunger core the cylinder of liquid metal contained in the pouring tube 5. The wall of the tube of the inductor, connected to a generator 11$^a$ located outside the vessel 1, carries a current the frequency of which is of the order of 4,000 Hz and water which flows through the tube cools the latter. The power of the generator 11$^a$ is, for example, from 100 to 200 Watts. When it is excited, the inductor 11 generates a signal as will be explained hereinafter.

The device 12 is a pressure sensor which is capable, when excited, of producing a signal which is a function of the pressure prevailing in the vessel 1 above the liquid metal.

The inlet and outlet circuits for the driving gas employed are the following:

Leading from the outlet orifice 7 of the vessel 1 is a conduit 13 which is connected to an exhaust 14 with interposition of a piloted exhaust valve 15.

With regard to the inlet, a conduit 17, the median part of which comprises two branches 18 and 19, connects the orifice 6 of the vessel 1 to a source of pressure 20. A pressure reducing valve 21 is provided in the branch 19 and the branch 18 comprises a pressure tank 22 and a piloted regulating pressure reducing valve 23 is placed on the upstream side of the tank 22 and a piloted valve 24 is placed on the downstream side thereof. A control device 25 is associated with the valve 24 and it may be a manual control device actuated by an operator or an automatic control device actuated, for example, by the placing of a mould 3 in position on the tube 5. This control device 25 is provided with a clock so as to time the opening of the valve 24 during a predetermined period of time when it is actuated.

If air is employed for producing the pressure for causing the metal 2 to flow, the source of pressure 20 may be constituted, for example, by a branch connection to a compressed air network of the apparatus.

Various signal transmitting lines or control lines L1, L2, L3, L4 and L5 connect the pressure sensor 12, the control device 25 and the level detector 11 to the piloted valves 15 and 24 and to the pressure reducing valves 21 and 23. These lines may be hydraulic, pneumatic or electric control lines. More precisely:

line L1 connects the level detector 11 to the pressure reducing valve 21 located in the branch 19 of the inlet pipe 17;

line L2 connects the pressure sensor 12 to the piloted valve 24 and to the pressure reducing and regulating valve 23;

line L3 is for controlling the piloted valve 24 by means of the control device 25;

line L4 connects the pressure sensor 12 to the piloted valve 15 provided for the exhaust pipe 13, and line L5 connects the level detector 11 to the piloted valve 15.

FIG. 1 groups two modes of operation, the first employing the lines L1, L2, L3, L4 and the other employing the lines L1, L2, L3, L5. To change from one mode to the other, the line L4 is replaced by the line L5 or vice versa. Thus, according to the mode employed, the valve 15 may be piloted either by a signal sent through the line L5 by the level detector 11 or by a signal sent through the line L4 by the pressure sensor 12.

The piloted valve 24 is brought from the completely open position to the completely closed position and vice versa by the control device 25. The completely open position of this valve can be regulated as a function of the signals from the pressure sensor 12. Thus the valve 24 has a double closure means: a closure member allowing the open position or the closed position and a flow setting or regulation to permit regulating the passage orifice when the valve is open. The valve 15 is of the same type but the signal it receives through the line L4 or L5 itself determines a flow setting and the total opening at this flow of the valve, during a predetermined time owing to a clock provided for this valve.

The pressure reducing and regulating valve 23, in response to the signals received by way of the line L2, sets a pressure. It opens when the downstream pressure is lower than that corresponding to the set pressure and closes when the downstream pressure becomes equal to that corresponding to the set pressure; it therefore operates as a check valve having an adjustable pressure setting.

The pressure reducing valve 21 comprises a pre-regulated pressure reducer and a closure member which opens and closes in accordance with the signal it receives through the line L1.

The level detector or inductor 11 delivers a signal whose intensity is a function of the level of the metal in the tube 5. When this level is lower than the level N the signal produced by the detector 11 permits either increasing the inlet pressure when it is sent through the line L1, or stopping the exhaust flow from the line L5 when it is sent through the line L5. Likewise, when the level of the metal is above the level N in the pouring tube 5, the signal produced by the detector 11 permits either establishing a pressure exhaust flow or stopping the pressure inlet flow.

The apparatus just described operates in the following manner:

The pressure P serving to cause flow of the metal 2 is divided into two: $P = PO + PC$.

The pressure PO, or "pre-pressure" is the pressure which must be admitted into the vessel 1 so that the metal reaches the level N in the pouring tube 5. This pressure varies with the level of the metal in the vessel 1, which level is between N1 and N2. This pressure is equal to the height of the column of metal in the tube 5, that is to say, the difference between the level N and the level of the metal contained in the vessel. By way of example, one bar corresponds roughly to a height of 1.4 m of iron. Bearing in mind the dimensions of the apparatus, it can be seen that the pressure PO will have a value between a value slightly higher than atmospheric pressure (difference between N and N2) and a maximum value of the order of a few bars, the maximum difference in levels being the distance between N and N1. The pressure reducing valve 21 is set to this maximum pre-pressure.

The pressure PC or "pouring pressure", is the pressure which must be admitted into the vessel 1, in addition to the pressure PO, to cause the metal to rise from its level N in the pouring tube 5 to a level permitting a good filling of the cavities of the mould 3.

The invention proposes maintaining at every instant between two pourings a pressure PO inside the vessel 1 which permits conforming to the level N in the tube 5. As all the moulds 3 are identical, the pressure PC is a constant irrespective of the level of the metal in the vessel 1. The invention proposes also admitting during the pouring phases this constant pressure PC which is added to the pressure PO.

First mode: Reference will be made to FIGS. 1 and 2 in which the lines L1, L2, L3, L4 alone will be considered and the line L5 neglected.

To initially start up the device (stage AB of FIG. 2), a first mould 3 is disposed on the end 4 of the pouring tube 5. The pressure inside the vessel 1 above the level of the liquid metal is the atmospheric pressure. The metal is therefore at the same level n in the vessel and in the pouring tube 5. The level detector 11 is excited in a continuous manner and produces a signal which results from the absence of metal inside the copper tube 10, that is to say the absence of the plunger core. The signal produced is transmitted through the line L1 to the pressure reducing valve 21, which is directly connected through the branch 19 to the source of pressure 20, and opens this valve. Consequently, a rise in pressure is produced in the vessel 1 which causes the level of the metal in the tube 5 to rise. When the level N is reached, the signal produced by the level detector 11 and transmitted through the line L1 causes the pressure reducing valve 21 to be closed. The level of the metal in the vessel becomes N2 and that of the metal in the tube 5 N. The pressure PO defined hereinbefore prevails inside the vessel.

The sensor 12 is then excited and produces a signal corresponding to the sensed pressure PO. This signal, sent through the line L2, sets in the pressure reducing valve 23, the pressure PO + PC and in the piloted valve 24 such a flow that the passage from PO to PO + PC occurs during a predetermined time $t_{MP}$, termed "pressure rise time". This setting causes the pressure reducing valve 23 to deliver a pressure PO + PC to the tank 22, which tank will serve as a source of pressure for the pouring operation.

The apparatus is then ready for the first pouring operation which is carried out in the following manner:

The control device 25 (which is manual or automatic and programmed) controls through the line L3 the complete opening of the valve 24 corresponding to the setting produced by the signal of the pressure sensor 12. The level of the metal in the tube 5 rises and the cavities of the moulds 3 are filled. During this time, the level N2 descends. The mould is correctly filled when a time $t_c$ for maintaining the pressure has elapsed, as explained in said French patent application No. 74 42 713. At the end of the time $t_{MP} + t_c$, the device 25 closes the valve 24.

The pressure detector 12 is then again excited. It senses inside the vessel 1 a pressure higher than the pressure PO and produces a signal in the line L4. This signal has a double effect: on one hand, it sets in the valve 15 a flow corresponding to the passage from PO + PC to PO within a predetermined time $t_{DP}$ termed "pressure drop time" and, on the other hand, it causes the complete opening of the valve 15 during the time $t_{DP}$. Thus when this time has elapsed, the pressure in the vessel 1 has returned to the initial pressure PO (point C of FIG. 2). The first pouring has finished.

As a part of the metal has been supplied to the mould, the level in the tube 5 is lower than the level N. In this first mode of operation, at the end of the first pouring, it is therefore necessary, before starting the second pouring, to establish inside the vessel 1 a pressure PO1 higher than PO. The pressure PO1 is obtained from the pressure PO in the same way as the pressure PO was obtained from the atmospheric pressure ($P = O$), that is to say, by means of the inductor 11 and the pressure reducing valve 21.

FIG. 2 illustrates this operation and shows the variations in the pressure P prevailing in the vessel 1, as a function of time t. Note that the time CD of passage from PO to PO1 is much shorter than the time CE for replacing the first mould by the second.

Second mode of operation (FIGS. 1 and 3, lines L1, L2, L3 and L5): This mode permits, after the first pouring, not releasing the pressure down to its initial level PO, but bringing the pressure down directly to the value PO1 effectively corresponding to the level N in the pouring tube 5. For this purpose, instead of employing the line L4 delivering the signal produced by the sensor 12, there is employed, for controlling the exhaust valve 15 the line L5 which transmits a signal produced by the level detector 11.

The operation for the final stage of the first pouring is then as follows. The level detector 11 is excited in a continuous manner at the end of the time $t_{MP} + t_c$. The presence of the plunger core throughout the height of the inductor causes the latter to produce a signal which acts on the piloted valve 15 in the same way as the signal sent through the line L4 in the first mode. The level in the pouring tube 5 descends and, when it reaches the level N, the signal produced by the level detector 11 is such that it causes the closure of the piloted exhaust valve 15. Thus there is here directly obtained the level N with no need to effect between each pouring the re-adjustment from PO to PO1. Note that the pressure drop time is not exactly equal to the predetermined time $t_{DP}$, but is slightly less since PO1 > PO. However, the difference between the two times is negligible in practice.

The invention provides a third mode which has not been illustrated. If it is considered that the difference PO1 − PO, PO2 − PO1, etc., is theoretically a constant of the apparatus, this basic parameter can be directly employed for effecting the re-adjustment of PO between two pourings, solely by the calculation of the pressures and flows to be set, for each pouring, in the devices 15, 23 and 24 and by the corresponding programming of the latter. In this mode, the level detector 11 and the pressure sensor 12 serve solely to initially start up the apparatus, and possibly to effect a re-adjustment in the case where there would be marked variations of the difference between two successive values of PO.

By means of the invention there is obtained a very good reproducibility of the mould filling conditions, and consequently great homogeneity of the quality of the cast parts.

Note that the induction field produced by the inductor 11 enables the upper end of the pouring tube 5 to be heated. This upper end has a tendency to cool down owing to the close vicinity of the surrounding air and to the fact that the liquid iron recovered after each pouring is colder than the iron contained in the vessel.

Moreover, the detector 12 may be employed for signalling when the pressure PO reaches the value corresponding to the level N1, that is to say, when the vessel must be filled with metal. The detector 12 may also serve to signal an abnormally slow pressure rise or excessive pressure variations when passing through the theoretical pressure levels, which permits detecting abnormal incidents such as the presence of cracks in the tube 5 or leakages in the vessel. This is important in the case of a highly automatized apparatus.

It must be understood that the invention is not intended to be limited to the pouring of iron. However, when the liquid to be poured is not magnetically conductive, use must be made, for the measurement or the detection of the level of this liquid, of means other than an inductor, for example a device employing $\gamma$ rays.

In the foregoing description, the various automatic parts of the apparatus have not been described in detail, since those skilled in the art would have no difficulty in constructing the electric or other circuits required to perform the described functions of these parts.

Having now described my invention what I claim as new and desire to secure by Letters Patent is:

1. In a process for controlling a liquid in a liquid-containing vessel having a pouring tube having an end portion defining an outlet and an opposite end portion immersed in the liquid, for a repeated pouring of the liquid under a low pressure into sand moulds, each of which moulds comprises at least one mould cavity and a liquid inlet passageway, combined with means for precluding a return flow of the liquid from the mould cavity after the liquid has filled said cavity, said liquid being controlled by means of a driving gas under pressure supplied to the interior of the vessel above the liquid in the vessel; the improvement comprising in combination the steps of:

placing the mould on said outlet of the tube to enable the supply of the liquid to the cavity by way of said passageway;

supplying said gas under a first pressure to the interior of the vessel above the liquid to raise the liquid in the tube;

detecting the arrival of the liquid at a predetermined level in the tube;

stopping the flow of the gas under said first pressure when said predetermined level is reached;

measuring the pressure of the gas above the liquid in the vessel to detect a second pressure representing the pressure of the gas when said predetermined level of the liquid in the tube is reached;

supplying the gas to the interior of the vessel above the liquid at a pressure which creates a third pressure in the vessel which is higher by a predetermined amount than said second pressure and at a predetermined rate of flow so as to raise the level of the liquid in the tube beyond said predetermined level and fill the cavity of the mould during a predetermined time;

maintaining said third pressure for a predetermined period so as to allow said means for precluding return of the liquid to operate;

reducing the pressure of the gas above the liquid inside the vessel so as to bring the level of the liquid in the tube down to substantially said predetermined level and create conditions for a further pouring procedure for a second mould placed on said outlet of the tube.

2. A process as claimed in claim 1, comprising, after said third pressure has been maintained for said predetermined period, reducing the pressure prevailing in the vessel to said second pressure and then, for effecting a pouring of a second mould, increasing the pressure prevailing in the vessel until the liquid in the pouring tube has risen to said predetermined level.

3. A process as claimed in claim 1, comprising, after said third pressure has been maintained for said predetermined period, putting the driving gas in the vessel in communication with an outlet while measuring the level of the liquid in the pouring tube and stopping the outlet of the gas when the liquid has descended to said predetermined level.

4. A device for controlling a closed liquid-containing vessel for repeatedly pouring the liquid from the vessel under a low pressure into sand moulds, each of which sand moulds comprises at least one mould cavity and a liquid inlet passageway which is combined with means for precluding a return flow of the liquid from the mould cavity after the liquid has filled said cavity, the device comprising an upwardly extending pouring tube having a lower end portion immersed in the liquid in the vessel and an upper end portion extending out of the vessel and defining a liquid outlet for receiving the mould so as to supply the liquid to said cavity via said tube outlet and said inlet passageway of the mould, a source of gas under pressure, an inlet communicating with the interior of the vessel above the liquid, an outlet communicating with the interior of the vessel above the liquid, first conduit means putting the source in communication with said inlet, second conduit means putting the source in communication with said inlet, pressure-reducing first valve means inserted in the first conduit means for supplying the gas to the vessel at a first pressure, pressure-reducing second valve means inserted in the second conduit means, means inserted in the second conduit means for producing a given rate of flow of the gas in the second conduit means, detector means associated with the tube for detecting a predetermined level of the liquid in the tube, a pressure sensor for responding to a second pressure of the gas prevailing in the vessel above the liquid and representing the pressure of the gas when the liquid is at said predetermined level in the tube, exhaust valve means associated with said outlet for controlling the discharge of the gas from the vessel, the detector means being associated with the first valve means and operative to close the first valve means when the liquid reaches said predetermined level in the tube, the second valve means being associated with the pressure sensor for producing a third pressure of the gas in the vessel which is higher than said second pressure by a predetermined amount, means being associated with the second conduit means for maintaining said third pressure for a given period to allow said means for precluding a return flow of the liquid to operate, and the exhaust valve means being associated with one of two elements consisting of the pressure sensor and the detector means for reducing the gas pressure in the vessel and bringing the liquid in the tube down to substantially said predetermined level for putting the device in a condition for filling a following mould.

5. A device as claimed in claim 4, for pouring magnetically conductive liquids, in particular metals having a high melting point, wherein the detector means comprise an alternating current generator, an inductor disposed around an upper part of the pouring tube inside the vessel and connected to the generator, a column of said liquid contained in the pouring tube being employed as a plunger core cooperative with the inductor.

6. A device as claimed in claim 5, wherein the inductor comprises a refractory material surrounding the tube, and a metal tube which is coiled into a spiral and is embedded in the refractory material.

7. A device as claimed in claim 6, further comprising a device for circulating cooling water in the metal tube of the inductor.

8. A device as claimed in claim 4, wherein it is the pressure sensor which is associated with the exhaust valve means for reducing the pressure of the gas down to said second pressure before filling the following mould.

9. A device as claimed in claim 4, wherein it is the detector means which is associated with the exhaust valve means for reducing the pressure of the gas until said predetermined level is reached after the mould is filled and before filling the following mould.

10. A device as claimed in claim 9, further comprising means associated with the exhaust valve means for ensuring that the gas pressure in the vessel is reduced at a given rate of flow after each mould filling.

11. A device as claimed in claim 8, further comprising means associated with the exhaust valve means for ensuring that the gas pressure in the vessel is reduced at a given rate of flow after each mould filling.

* * * * *